US011376867B2

(12) United States Patent
Ihara

(10) Patent No.: US 11,376,867 B2
(45) Date of Patent: Jul. 5, 2022

(54) PRINTING APPARATUS

(71) Applicant: SEIKO EPSON CORPORATION, Tokyo (JP)

(72) Inventor: Seiji Ihara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 16/907,630

(22) Filed: Jun. 22, 2020

(65) Prior Publication Data

US 2020/0398565 A1 Dec. 24, 2020

(30) Foreign Application Priority Data

Jun. 24, 2019 (JP) ..... JP2019-116203

(51) Int. Cl.
*B41J 11/00* (2006.01)
*B41J 2/14* (2006.01)

(52) U.S. Cl.
CPC ..... *B41J 11/0022* (2021.01); *B41J 2/1408* (2013.01); *B41J 2/14088* (2013.01); *B41J 11/0024* (2021.01); *B41J 11/00242* (2021.01)

(58) Field of Classification Search
CPC .... B41J 2/1408; B41J 2/14088; B41J 11/002; B41J 11/00242; B41J 11/0024; B41J 11/0022; B41J 2/0454; B41J 29/377; B41J 2202/08
See application file for complete search history.

(56) References Cited

U.S. PATENT DOCUMENTS 10,336,105 B2 * 7/2019 Sakai ..... B65H 19/265

FOREIGN PATENT DOCUMENTS

JP 2014-156128 A 8/2014
JP 2014-184676 A 10/2014

* cited by examiner

*Primary Examiner* — Kristal Feggins
(74) *Attorney, Agent, or Firm* — Workman Nydegger

(57) ABSTRACT

The printing apparatus includes a support part (platen) configured to support a recording medium (roll sheet), a printing part (printing unit) configured to form an image by discharging ink to a roll sheet supported on a platen while reciprocating in a main scanning direction, and a drying acceleration part configured to accelerate drying of the ink discharged by the printing unit and applied on the roll sheet in a state where the roll sheet is supported on the platen, in which a drying capacity of the drying acceleration part is higher in an end region of the platen than in a central region of the platen in a reciprocation direction of the printing unit.

6 Claims, 11 Drawing Sheets

| COMBINATION | PRINTING UNIT | | DRYING UNIT | | |
|---|---|---|---|---|---|
| | PRINTING CONDITION | | FIXED BLOWER | HEATER | CARRIAGE BLOWER |
| | | | AIR VELOCITY CONTROL CONDITION | HEATING TEMPERATURE CONTROL CONDITION | AIR VELOCITY CONTROL CONDITION |
| A | UNIDIRECTIONAL PRINTING | 1 PASS | (1) OR (2) | (1) OR (2) | (1) OR (2) |
| B | | 2 OR MORE PASSES | (1) | (1) | (1) |
| C | BIDIRECTIONAL PRINTING | 2 PASSES | (1) | (1) | (2) OR (3) |
| D | | | | (2) | (2) OR (3) |
| E | | 3 OR MORE PASSES | (2) | (1) | (2) OR (3) |
| F | | | | (2) | (2) OR (3) |

FIG. 13

PRINTING APPARATUS

The present application is based on, and claims priority from JP Application Serial Number 2019-116203, filed Jun. 24, 2019, the disclosure of which is hereby incorporated by reference herein in its entirety.

BACKGROUND

1. Technical Field

The disclosure relates to a printing apparatus.

2. Related Art

In the related art, a configuration of an inkjet printer is known in which a fan is disposed above a platen in such a manner as to overlap the platen in plan view for the purpose of achieving good printing quality while ensuring productivity for ink discharged from a recording unit (printing part) on a recording medium on the platen (e.g., JP-A-2014-156128).

In JP-A-2014-156128, air of the fan is uniformly blown to the entire region of the recording medium so as to uniformly dry the ink on the recording medium. However, as a result of the experiment conducted by the inventors, it was confirmed that depending on the conditions, ink may smear in regions of the recording medium that correspond to end regions of the platen in the main scanning direction of a carriage. As such, it has been desired to suppress the occurrence of a smear of ink in the regions of the recording medium that correspond to the end regions of the platen so as to achieve good printing quality.

SUMMARY

A printing apparatus according to the disclosure includes a support part configured to support a recording medium, a printing part configured to form an image by discharging ink to the recording medium supported by the support part while reciprocating in a main scanning direction, and a drying acceleration part configured to accelerate drying of the ink discharged by the printing part and applied on the recording medium in a state where the recording medium is supported by the support part, wherein a drying capacity of the drying acceleration part is set such that the drying capacity is higher in an end region of the support part than in a central region of the support part in a reciprocation direction of the printing part.

In the above-described printing apparatus, the reciprocation direction of the printing part and a transport direction of the recording medium may be parallel to each other.

In the above-described printing apparatus, the drying acceleration part may be a plurality of fixed fans disposed above the printing part in such a manner as to face the support part, and an air velocity of the fixed fan that is disposed at a position facing the end region of the support part may be greater than an air velocity of the fixed fan that is disposed at a position facing the central region of the support part.

In the above-described printing apparatus, the drying acceleration part may be a heater provided at the support part, and a heating temperature of the heater disposed in the end region of the support part may be higher than a heating temperature of the heater disposed in the central region of the support part.

In the above-described printing apparatus, the drying acceleration part may be a carriage fan disposed on both sides of a carriage in the reciprocation direction, the carriage being configured to support a print head and move in the main scanning direction, the print head being configured to discharge the ink, and the carriage fan may be set such that an air velocity in the end region of the support part is greater than an air velocity in the central region of the support part.

In the above-described printing apparatus, the drying acceleration part may be a carriage fan disposed on both sides of a carriage in the reciprocation direction, the carriage being configured to support a print head and move in the main scanning direction, the print head being configured to discharge the ink, an air velocity of the carriage fan disposed upstream in a transport direction of the recording medium may be changed such that the air velocity is small in an upstream end region, intermediate in the central region, and large in a downstream end region in the transport direction in the support part, and an air velocity of the carriage fan disposed downstream in the transport direction may be changed such that the air velocity is large in the upstream end region, intermediate in the central region, and small in the downstream end region.

BRIEF DESCRIPTION OF THE DRAWINGS

FIG. 13 is a table showing a suitable combinations of control conditions of a drying unit with respect to printing conditions.

DESCRIPTION OF EXEMPLARY EMBODIMENTS

1. Embodiment

An embodiment of a printing apparatus 1 according to an embodiment of the disclosure will be described below with reference to the accompanying drawings. In this embodiment, the printing apparatus 1 is a printing apparatus 1 that transports a base material by a roll-to-roll system. An inkjet printer will be described as an example of the printing apparatus 1.

Figure 1:
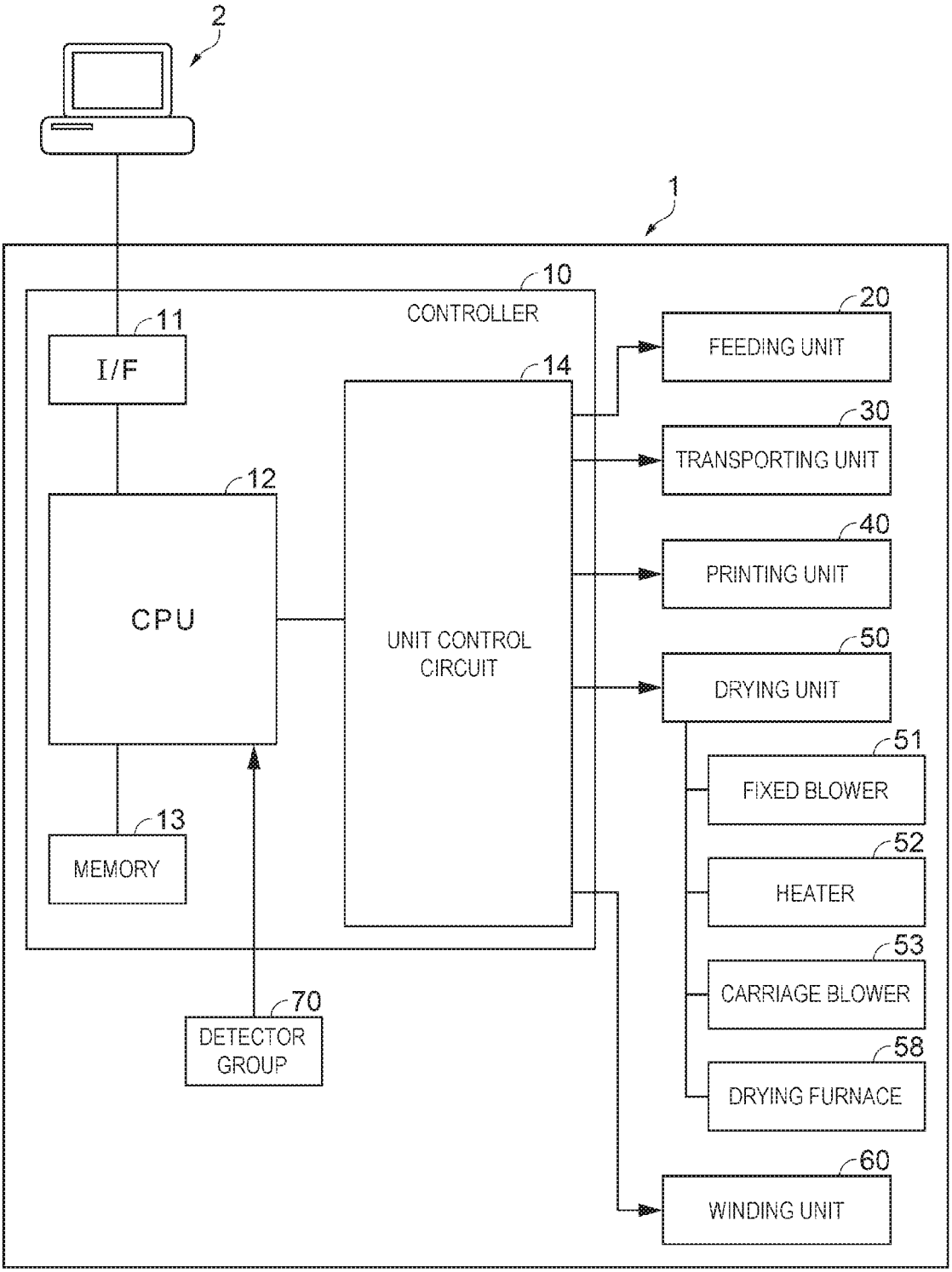
FIG. 1 is a schematic block view illustrating a configuration of a printing apparatus of an embodiment.
Figure 2:
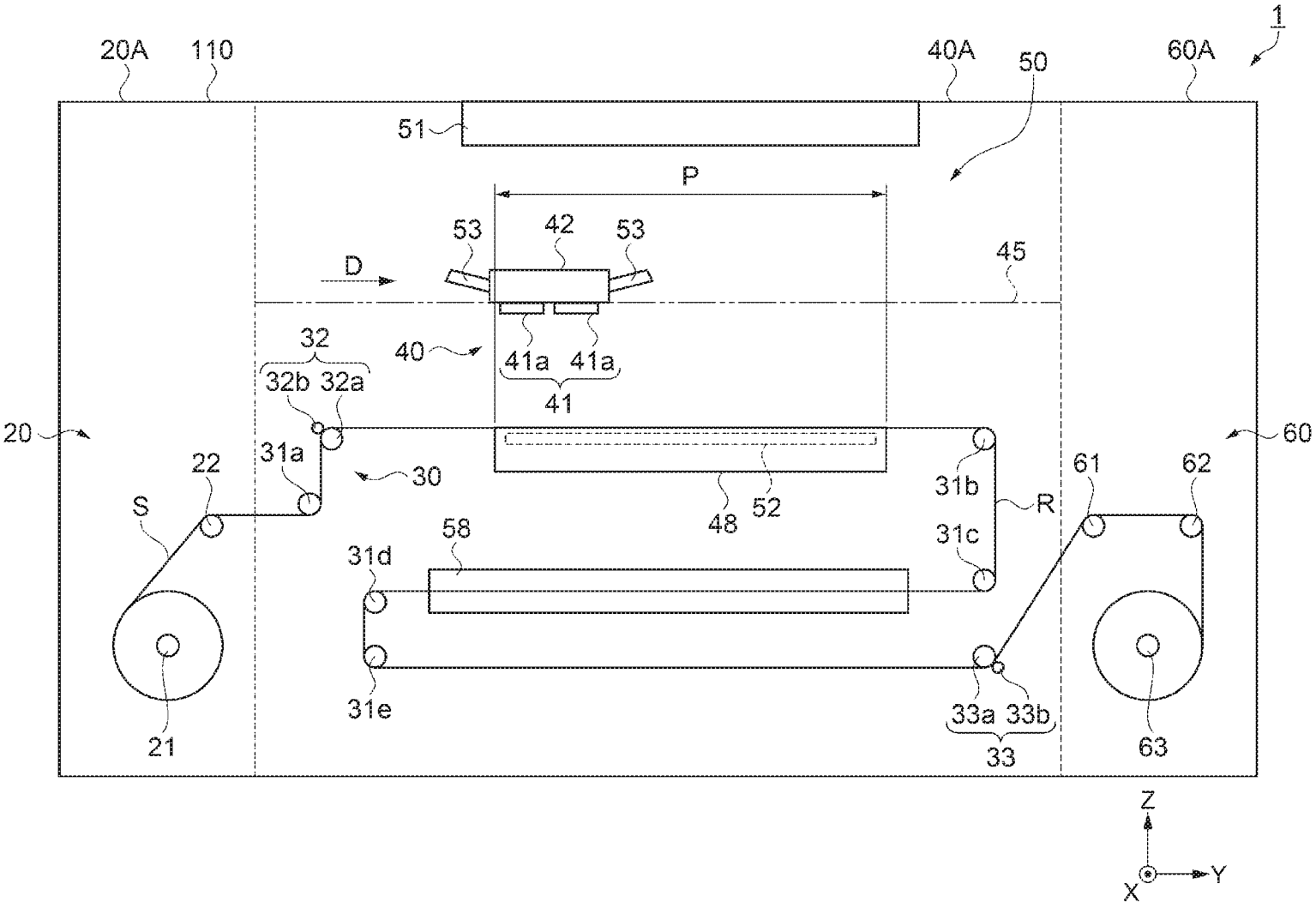
FIG. 2 is a schematic front view illustrating a configuration of the printing apparatus of the embodiment.

FIG. 1 is a schematic block view illustrating a configuration of the printing apparatus 1 according to this embodiment. FIG. 2 is a schematic front view illustrating a configuration of the printing apparatus 1 according to this embodiment. Note that the drawings are not drawn to scale.

For the sake of description, an XYZ coordinate system is used on the basis of a case where the printing apparatus 1 is placed on a horizontal surface. Specifically, the front-rear direction of the printing apparatus 1 is set as the X direction, the front direction or front side is set as the +X direction, and the rear direction or the rear side is set as the −X direction. The left-right direction that is orthogonal to the X direction of the printing apparatus 1 in the horizontal plane is set as the Y direction, the left direction or the left side is set as the −Y direction, and the right direction or the right side is set as the +Y direction. The direction that is orthogonal to the X direction and the Y direction of the printing apparatus 1, or in other words, the direction orthogonal to the horizontal plane is set as the Z-direction, the upper direction or the upper side is set as the +Z direction, and the lower direction (gravity direction) or the lower side is set as the −Z direction. The directions are defined as described above and are appropriately used in the following description.

The printing apparatus 1 according to this embodiment prints an image by discharging ink as liquid to a roll sheet (continuous sheet) S as a recording medium. In addition, the printing apparatus 1 is communicably connected to a computer 2, and the computer 2 creates print data for printing an image at the printing apparatus 1. Note that the function of the computer 2 may be included in the printing apparatus 1.

As illustrated in FIG. 1, the printing apparatus 1 includes a controller 10, a feeding unit 20, a transporting unit 30, a printing unit 40, a drying unit 50, a winding unit 60, and a detector group 70. In addition, as illustrated in FIG. 2, the printing apparatus 1 includes a main body case 110 having a cuboid shape. The main body case 110 is broadly divided into three sections in the left-right direction, and may be sectioned as, from left to right, a feeding region 20A, a printing region 40A, and a winding region 60A.

The controller 10 is a control unit configured to control the printing apparatus 1. An interface 11 is configured to receive and/or transmit data between the computer 2 and the printing apparatus 1. A CPU 12 is an arithmetic processing unit configured to perform overall control of the printing apparatus 1. A memory 13 is configured to secure a work area and/or a storage area of a program of the CPU 12. The CPU 12 controls each unit in accordance with a unit control circuit 14. Note that the detector group 70 monitors the status inside the printing apparatus 1, and on the basis of the detection results, the controller 10 controls each unit.

The feeding unit 20 is configured to feed the roll sheet S to the transporting unit 30. As illustrated in FIG. 2, the feeding unit 20 includes a rotatably supported winding shaft 21 on which the roll sheet S is wound and a relay roller 22 configured to wind the roll sheet S fed from the winding shaft 21 and guide the roll sheet S to the transporting unit 30. Note that the feeding unit 20 is located in the feeding region 20A on the left side in the main body case 110.

The transporting unit 30 transports the roll sheet S along a predetermined transport path R with a plurality of transport rollers. As the transport rollers, the transporting unit 30 includes a plurality of relay rollers 31*a* to 31*e*, a supply roller 32 disposed upstream of a printing region P, and a discharge roller 33 disposed downstream of the printing region P. The roll sheet S moves through the plurality of transport rollers in sequence, and thus the transport path R for transporting the roll sheet S is formed. Note that the printing region P is a region where the print head 41 performs scanning movement and printing on the upper surface of a platen 48.

The feed roller 32 and the discharge roller 33 are each composed of a pair of rollers. One of the paired rollers is driving rollers 32*a* and 33*a* that are rotated by a motor (not illustrated), and the other roller is driven rollers 32*b* and 33*b* that rotate in conjunction with the driving rollers. The feed roller 32 and the discharge roller 33 transport the roll sheet S by sandwiching the roll sheet S between the paired rollers.

The feed roller 32 and the discharge roller 33 transport the roll sheet S and supply the roll sheet S to the printing region P. The feed roller 32 and the discharge roller 33 temporarily stop the transport for a time period during which printing is performed on the portion of the roll sheet S in the printing region P.

When printing of an image for the roll sheet S located in the printing region P is completed, the feed roller 32 and the discharge roller 33 transport the portion of the roll sheet S on which the image has been printed from the printing region P to a drying furnace 58, and supply, to the printing region P, a new portion of the roll sheet S where no image has been printed. In other words, the roll sheet S is intermittently transported in a unit of the printing region P. In the printing apparatus 1 according to this embodiment, the controller 10 (control unit) alternately repeats the operation of transporting roll sheet S of the transporting unit 30 and the image printing operation of the printing unit 40.

The printing unit 40 as a printing part forms (prints) an image by discharging ink to the roll sheet S located in the printing region P while reciprocating in the main scanning direction. The printing unit 40 includes a print head 41 that performs printing by discharging ink in the printing region P, and a carriage 42 that supports the print head 41 and reciprocates in the main scanning direction (Y direction).

In addition, the printing unit 40 includes the platen 48 as a support part that supports the roll sheet S from the rear surface side. Note that the platen 48 sucks the roll sheet S to the upper surface of the platen 48 from the rear surface side with a suction mechanism (not illustrated) to thereby hold the roll sheet S on the platen 48 at a predetermined position and secure the printing region P. Note that the printing region P is set to a region within a range from the upstream end (left end) to the downstream end (right end) of the platen 48, as a region where the print head 41 performs scanning movement.

The carriage 42 is configured to reciprocate in the main scanning direction (Y direction) together with the print head 41 along a carriage guide rail 45 (indicated by a two-dot chain line in FIG. 2) extending in the Y direction in the printing region P when the carriage motor (not illustrated) is driven. As such, in this embodiment, the direction of the reciprocating movement (the main scanning direction) and the transport direction D of the roll sheet S are parallel to each other.

In addition, a head guide rail (not illustrated) extending in a line direction (X direction: the width direction of the roll sheet S) is provided at the carriage 42, and the print head 41 is configured to move in the line direction (X direction) along the head guide rail when the carriage motor (not illustrated) is driven. Note that the scanning direction as the line direction is a sub-scanning direction. In this manner, the carriage 42 and the print head 41 can perform printing by reciprocating in the Y direction as the main scanning direction, and can move (to the next line) in the line direction (X direction) as the sub-scanning direction.

When performing the image printing operation of the printing unit 40, the controller 10 temporarily stops the transport of the roll sheet S at the feed roller 32 and the discharge roller 33. Then, the printing head 41 performs printing for one page by discharging ink to a portion of the stopped roll sheet S in the printing region P while reciprocating in the main scanning direction (Y direction) and moving in the sub-scanning direction (X direction).

Note that the method of discharging the ink from the nozzle in the printing operation may be a piezo method in which ink is discharged by applying a voltage to a driving element (piezoelectric element) so as to expand and contract the pressure chamber, or a thermal method in which air bubbles are generated in the nozzle using a heat generating element and ink is discharged using the air bubbles.

The drying unit 50 is configured as a drying acceleration part. The drying unit 50 is configured to promote the fixing of the image printed on the roll sheet S. Specifically, the drying unit 50 is configured to accelerate drying of the ink applied on the roll sheet S. In addition, the drying unit 50 (the drying unit 50 in a primary drying step) promotes drying of the ink in the state where the roll sheet S is supported by the platen 48. The drying unit 50 includes a fixed blower 51 disposed above the printing unit 40 in such a manner as to face the platen 48, a heater 52 provided at the platen 48, and a carriage blower 53 provided at the carriage 42. Note that the drying unit 50 will be described later.

The winding unit 60 is configured to wind the roll sheet S sent by the transporting unit 30 after the image printed on the roll sheet S is fixed to the roll sheet S at the drying unit 50. The winding unit 60 includes relay rollers 61 and 62 that transport in a winding manner the roll sheet S fed from the discharge roller 33, and a winding drive shaft 63 that winds the roll sheet S. Note that the winding unit 60 is located in the winding region 60A on the right side in the main body case 110.

Figure 3:
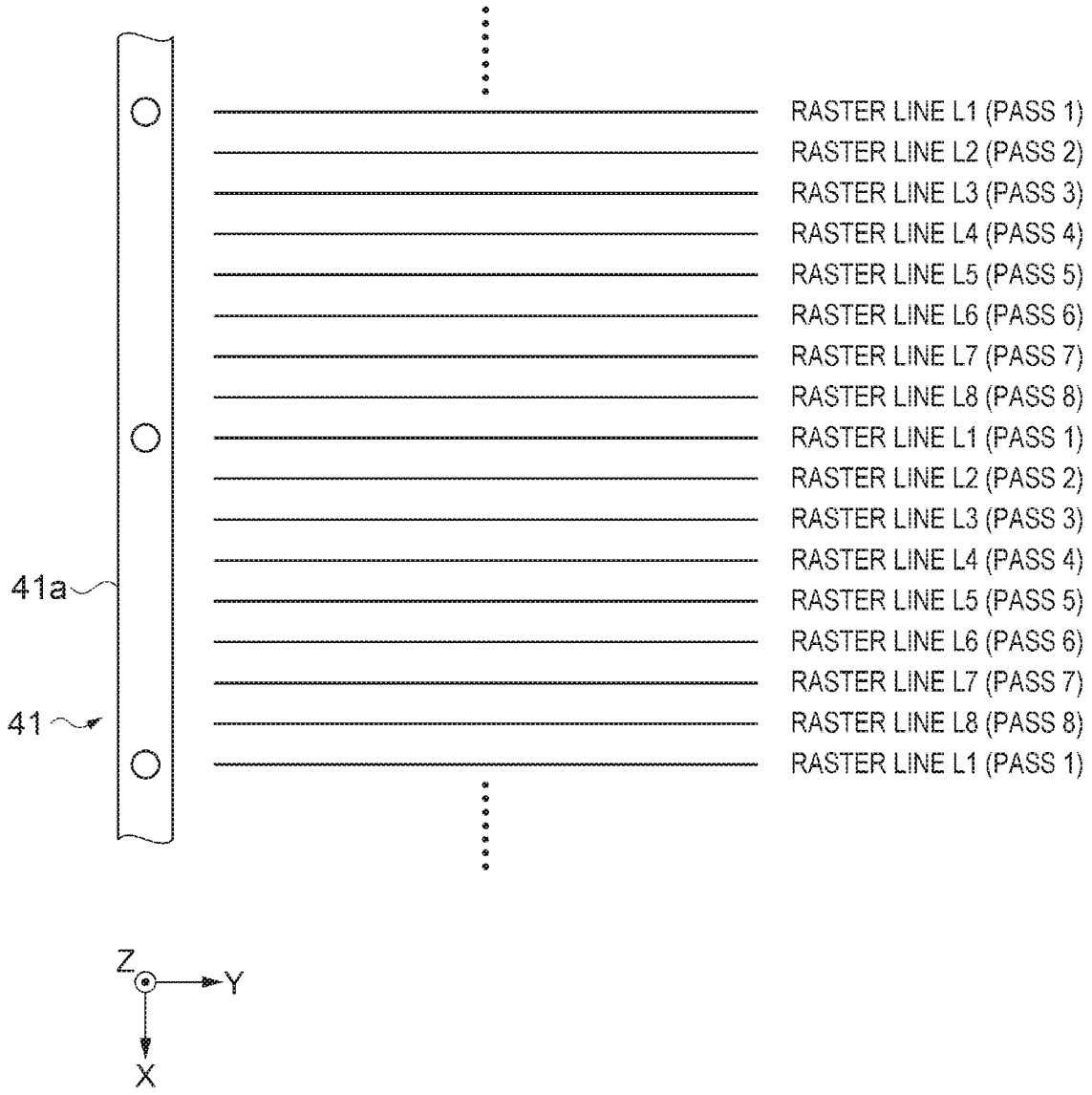
FIG. 3 is a schematic view illustrating raster lines formed in passes in a case of printing in eight passes in a printing operation (pass operation) of a printing unit.

FIG. 3 is a schematic view illustrating raster lines formed in passes in the case where printing is performed in eight passes in a printing operation (pass operation) of the printing unit 40.

The operation of the printing unit 40 is further described.

The print head 41 is composed of 15 print heads 41*a* in this embodiment. The print head 41*a* includes a plurality of nozzle lines, with nozzles aligned in the line direction (X direction), in the Y direction in accordance with the number of colors. In the print head 41, 15 print heads 41*a* are disposed in a staggered form along the X direction.

The controller 10 operates such that the nozzle discharges ink while the print head 41 reciprocates in the main scanning direction (Y direction) so as to form a raster line along the main scanning direction (Y direction), and thus printing for one page is performed in the portion of the roll sheet S in the printing region P. Note that, specifically, when the print head 41 reciprocates in the main scanning direction (Y direction), the head is moved in the main scanning direction (+Y direction) on the forward path, and then the head is moved in the sub-scanning direction (X direction) for the movement to the next line, and thereafter, the head is moved in the main scanning direction (−Y direction) on the backward path. Note that the operation of forming a raster line along the main scanning direction (Y direction) by discharging ink from the nozzle while moving the print head 41 back and forth in the main scanning direction (Y direction) is referred to as an image recording pass, or simply, a pass.

With reference to FIG. 3, operations in the case where printing (bidirectional printing) using a plurality of passes (four passes, six passes, eight passes, or the like) are described. Specifically, in order to increase the resolution of the image in the line direction, printing is performed while moving the position of the print head 41 little by little in the line direction (sub-scanning direction) for each pass. Note that, for example, publicly known interlace (micro weave) printing is performed as the image forming method (printing method).

In FIG. 3, a nozzle line of the print head 41 (the print head 41*a*) is illustrated on the left side, and raster lines are formed by discharging ink from the nozzles while the print head 41 (the nozzle line) moves in the main scanning direction (Y direction). The position of the nozzles in the line direction of the print head 41*a* (the nozzle line) illustrated in FIG. 3 is the position in the first pass, and when the print head 41*a* (the nozzle line) moves in the main scanning direction (in this case, the +Y direction) while maintaining this position, printing of the first pass is performed and three raster lines illustrated in the drawing (raster lines L1 indicated as PASS 1 on the right end) are formed. Note that in FIG. 3, straight raster lines with no break are illustrated for the sake of concise illustration, but the raster line breaks when there is no print data.

Then, when the print head 41*a* (the nozzle line) moves in the sub-scanning direction (+X direction) and the print head 41*a* (the nozzle line) maintaining the position after the movement moves in the main scanning direction (in this case, the −Y direction), printing of the second pass is performed, and two raster lines illustrated in the drawing (raster lines L2 indicated as PASS 2 on the right end) are formed. Note that since interlace (micro weave) printing is employed, the raster line L2 adjacent to the raster line L1 is formed by ink discharged from a nozzle different from the nozzle that discharges the ink for forming the raster line L1. Thereafter, the printing of third to eighth passes are performed through similar operations, and the remaining raster lines illustrated in the drawing (raster lines L3 to L8 indicated as PASS 3 to PASS 8 on the right end) are formed.

Note that in this embodiment, typical so-called bidirectional printing is performed. Bidirectional printing is a printing method in which in reciprocating movement in the main scanning direction, printing is performed on both the forward path and the backward path. In other words, the direction (in this case, the +Y direction as the forward path) in which the print head 41*a* (the nozzle line) moves during the printing of the first, third, fifth, and seventh passes, and the direction (in this case, the −Y direction as the backward path) in which the print head 41*a* (the nozzle line) moves during the printing of the second, fourth, sixth, and eighth passes are opposite to each other.

Note that in comparison with bidirectional printing, unidirectional printing is a printing method in which printing is performed only in one direction. Specifically, in unidirectional printing, printing is performed in the +Y direction as the forward path, while idle running is performed without performing the printing in the −Y direction as the backward path, and, such operations are repeated, for example.

The drying unit 50 is described.

As described above, the drying unit 50 is configured to accelerate drying of the ink applied on the roll sheet S to fix the image, and includes the fixed blower 51, the heater 52, and the carriage blower 53. The drying unit 50 is configured to perform the primary drying step.

The primary drying step is a part of a step of fixing an image, and includes an operation of suppressing a smear by evaporating the moisture in the applied ink. The primary drying step is performed on the platen 48. The primary drying step is performed with the fixed blower 51, the heater 52, and the carriage blower 53.

A secondary drying step is a step of evaporating a component, such as a solvent component, other than moisture in the applied ink. The secondary drying step is performed with the drying furnace 58. Note that since the solvent component has a higher boiling point than water, the solvent component is evaporated through the drying furnace 58 having a high temperature. In addition, there is ink containing a resin for fixing, and in the case where such ink is used, the resin is melted and fixed through the drying furnace 58. By way of the drying unit 50 and the drying furnace 58, the rear surface of the roll sheet S can be prevented from being soiled with the ink even when the roll sheet S that has been printed is wound on the winding unit 60, and thus a high-quality printed material can be provided.

Figure 14:
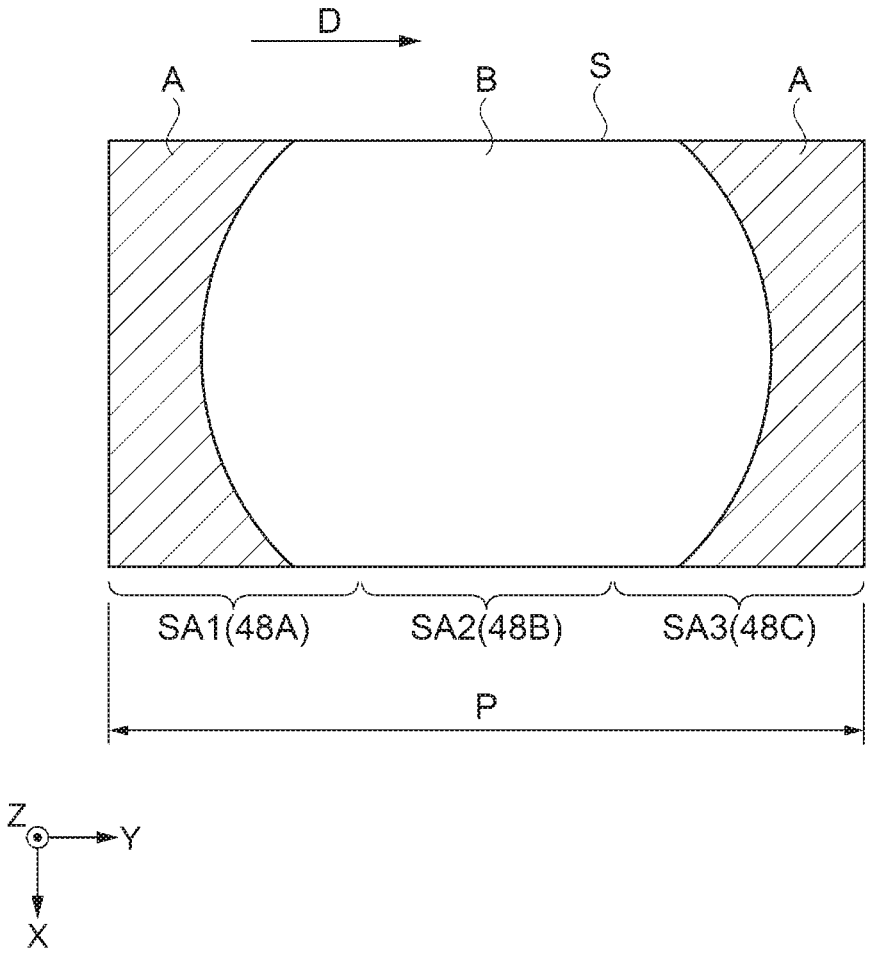
FIG. 14 is a schematic view illustrating a degree of a smear in the case where drying of the related art is performed.

FIG. 14 is a schematic view illustrating a degree of a smear that is caused when drying of the related art is performed. Specifically, for the printing, an image for evaluation was arranged over the surface in the printing region P of the roll sheet, and bidirectional printing of four passes was performed. In addition, the result was obtained under printing conditions that are most likely to cause a smear, such as low temperature high humidity and a roll sheet composed of a material that dries slowly.

Here, in the printing region P of the roll sheet S, the region on the upstream side in the transport direction D is referred to as an upstream end region SA1, a region on the downstream side in the transport direction D is referred to as a downstream end region SA3, and a central region sandwiched between the upstream end region SA1 and the downstream end region SA3 is referred to as a central region SA2. In addition, a region of the platen 48 corresponding to the upstream end region SA1 of the roll sheet S is referred to as an upstream end region 48A, a region of the platen 48 corresponding to the central region SA2 is referred to as a central region 48B, and a region of the platen 48 corresponding to the downstream end region SA3 is referred to as a downstream end region 48C.

In FIG. 14, a region A where a smear of ink occurred is hatched. In addition, a region B where no smear of ink is recognized is illustrated as a blank. As illustrated in FIG. 14, it is confirmed that, in the main scanning direction (Y direction) of the carriage 42, no smear of ink occurred in the central region SA2 of the roll sheet S, while a smear of ink (region A) occurred in the upstream end region SA1 and the downstream end region SA3 of the roll sheet S.

In the following description, the regions of the roll sheet S in the main scanning direction (Y direction) of the carriage 42 in the printing region P are described as the upstream end region SA1, the central region SA2, and the downstream end region SA3.

Figure 4:
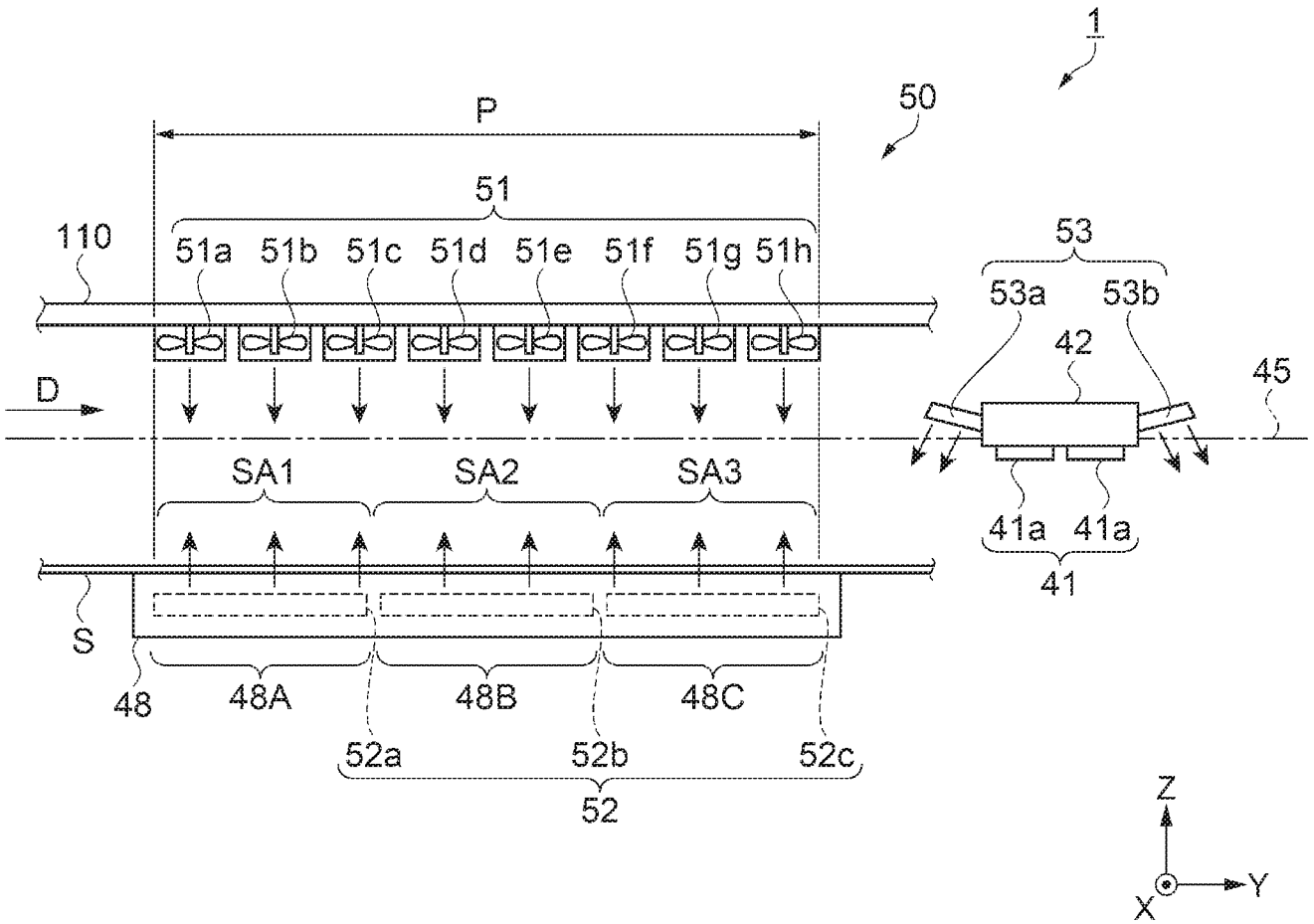
FIG. 4 is a diagram illustrating a drying unit.

FIG. 4 is a diagram illustrating the drying unit 50.

Hereinafter, the configurations and operations of the fixed blower 51, the heater 52, and the carriage blower 53 serving as the drying unit 50 serving as the drying acceleration part for performing the primary drying step are described. The drying unit 50 is configured to accelerate drying of the ink discharged by the print head 41 and applied on the roll sheet S in the state where the roll sheet S is supported by the platen 48.

First, the fixed blower 51 is described.

As illustrated in FIG. 4, the fixed blower 51 is disposed above the platen 48, the carriage 42 and the print head 41 serving as the printing part in such a manner as to face the platen 48 on the inner surface side of the top surface of the main body case 110. The fixed blower 51 is composed of a plurality of axial fans. Note that the fixed blower 51 is disposed in such a manner as to cover the printing region P in plan view such that the blowing direction is perpendicular to the roll sheet S on the platen 48 in the state where each rotation axis direction is aligned with the perpendicular direction. The fixed blower 51 sucks the outside air from an opening (not illustrated) that opens at the top surface of the main body case 110 via a filter (not illustrated), and discharges the air in the direction perpendicular to the roll sheet S.

Specifically, in plan view, the fixed blower 51 has a configuration of two lows and eight columns (two axial fans arranged in the X direction and eight axial fans arranged in the Y direction), and thus includes a total of 16 axial fans arranged therein. Note that the 16 axial fans have the same specification. The axial fans are controlled by the controller 10 such that, with the two axial fans arranged in the X direction as one unit, the control (the control of the drive voltage) of the eight units of the axial fans arranged in the Y direction are independently performed. The axial fans of eight units are referred to as fixed fans 51*a* to 51*h* in the order from the upstream side in the transport direction D of the roll sheet S. In this embodiment, the fixed fans 51*a* to 51*h* serving as the eight units uniformly cover the printing region P of the roll sheet S in plan view.

Figure 5:
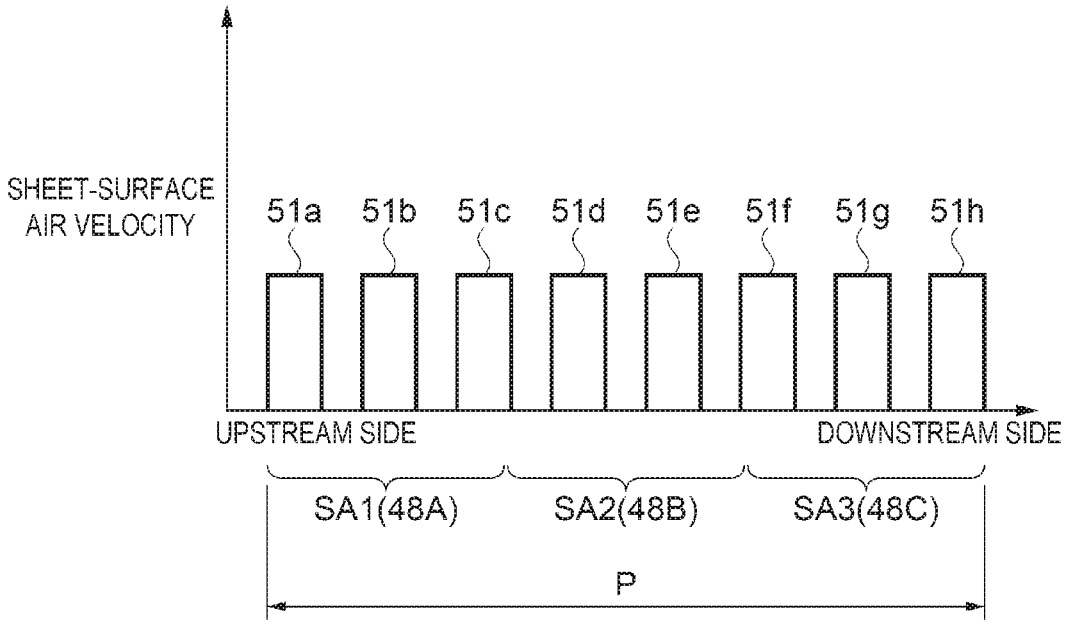
FIG. 5 is a diagram illustrating an air velocity distribution of a fixed blower.
Figure 6:
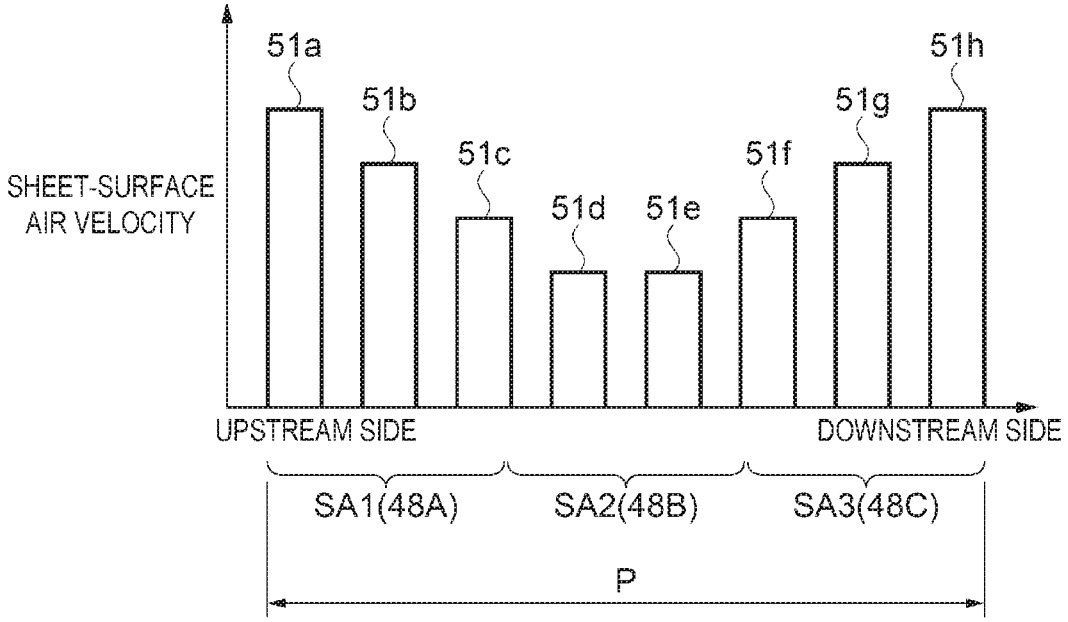
FIG. 6 is a diagram illustrating an air velocity distribution of the fixed blower.

FIGS. 5 and 6 are diagrams illustrating air velocity distributions of the fixed blower 51. Specifically, FIGS. 5 and 6 are diagrams illustrating air velocity distributions that indicate air velocities of the fixed fans 51*a* to 51*h* in the case where the fixed blower 51 is driven for each unit, as sheet-surface air velocities at the roll sheet S. Note that the sheet-surface air velocity refers to the air velocity at or near the sheet surface of the roll sheet S located in the printing region P. In this embodiment, as illustrated in FIGS. 5 and 6, the controller 10 controls the air velocity of the fixed blower 51 under air velocity distribution conditions of two types.

The air velocity distribution illustrated in FIG. 5 is a distribution that is controlled such that the sheet-surface air velocities of the fixed fans 51*a* to 51*h* are even sheet-surface air velocities (even airflow rates). Accordingly, during the printing operation of the carriage 42, the fixed blower 51 blows airflow of even air velocities (even airflow rates) toward the roll sheet S in the printing region P all over the upstream end region SA1, the central region SA2, and the downstream end region SA3 in the roll sheet S. Note that this air velocity distribution is the same as that of the related art.

Note that the air velocity distribution of the fixed blower 51 illustrated in FIG. 5 is referred to as an air velocity control condition (1).

Through the operation of the fixed blower 51 under the air velocity control condition (1), the moisture in the ink is evaporated with the airflow of the uniform sheet-surface air velocities (uniform airflow rates) in the upstream end region SA1, the central region SA2, and the downstream end region SA3 of the printing region P of the roll sheet S.

The air velocity distribution illustrated in FIG. 6 is controlled such that in the roll sheet S of the printing region P, the sheet-surface air velocity (airflow rate) of the fixed fan 51*a* facing the upstream end region SA1 is highest (largest) and that the sheet-surface air velocity (airflow rate) gradually decreases in the order of the fixed fans 51*b* and 51*c* toward the fixed fans 51*d* and 51*e* of the central region SA2. Further, the air velocity distribution illustrated in FIG. 6 is controlled such that the sheet-surface air velocity (airflow rate) of the fixed fan 51*h* facing the downstream end region SA3 is highest (largest) and that the sheet-surface air velocity (airflow rate) gradually decreases in the order of the fixed fans 51*g* and 51*f* toward the fixed fans 51*d* and 51*e* of the central region SA2. Note that the sheet-surface air velocity (airflow rate) of the fixed fans 51*d* and 51*e* is equal to the sheet-surface air velocity (airflow rate) of the even sheet-surface air velocities (airflow rates) illustrated in FIG. 5.

That is, in the air velocity distribution in FIG. 6, the air velocities of the fixed fans 51*a* to 51*c* facing the upstream end region SA1 and the fixed fans 51*f* to 51*h* facing the downstream end region SA3 are greater than the air velocity of the fixed fans 51*d* and 51*e* facing the central region SA2 in the roll sheet S of the printing region P. In other words, in the distribution, the air velocities of the fixed fans 51*a* to 51*c* and the fixed fans 51*f* to 51*h* facing the upstream end region 48A and the downstream end region 48C of the platen 48 are greater than the air velocity of the fixed fans 51*d* and 51*e* facing the central region 48B. To put it another way, in the drying unit 50 (fixed blower 51) serving as the drying acceleration part, the drying capacities are set such that the drying capacities of the upstream end region 48A and the downstream end region 48C serving as the end regions of the platen 48 are higher than that of the central region 48B of the platen 48.

Note that the air velocity distribution of the fixed blower 51 illustrated in FIG. 6 is referred to as an air velocity control condition (2).

In the upstream end region SA1 and the downstream end region SA3, where a smear of the ink easily occur, of the roll sheet S in the printing region P, the moisture in the ink can be evaporated and dried with the airflow of a sheet-surface air velocity (larger airflow rate) higher than that of the central region SA2 through the operation of the fixed blower 51 under the air velocity control condition (2) in the upstream end region SA1 and the downstream end region SA3.

Next, the heater 52 is described.

The platen 48 where the heater 52 is disposed has a rectangular shape, and is composed of a member having a high thermal conductivity such as aluminum having a thickness of 10 mm, for example. As illustrated in FIG. 4, the heater 52 is disposed in the lower surface of the platen 48, and is composed of an upstream heater 52*a* for heating the upstream end region 48A of the platen 48, a central heater 52*b* for heating the central region 48B, and a downstream heater 52*c* for heating the downstream end region 48C. A nichrome wire may be used as the heater 52, for example.

The platen 48 is provided with a temperature sensor (not illustrated) included in the detector group 70 that respectively detects the temperatures of the upstream heater 52*a*, the central heater 52*b*, and the downstream heater 52*c*. Thus, with the controller 10, they are independently controlled to respective set temperatures.

Figure 7:
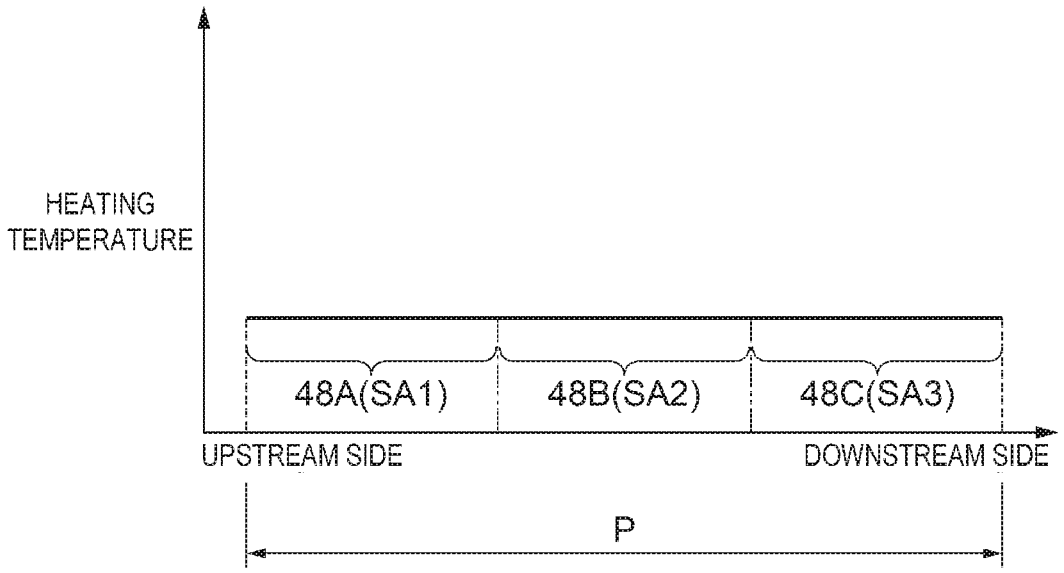
FIG. 7 is a diagram illustrating a heating temperature distribution of an upper surface of a platen.
Figure 8:
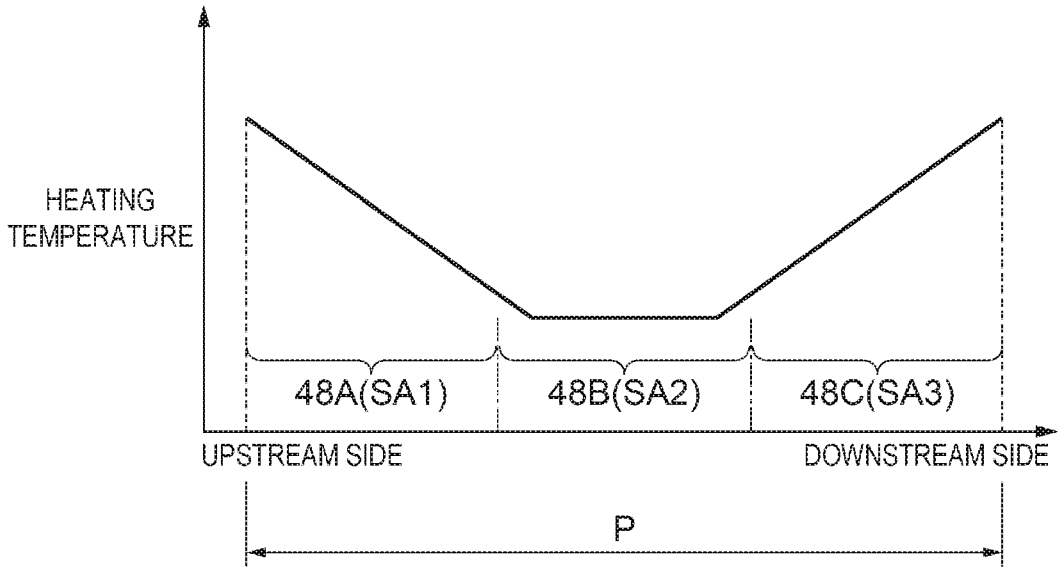
FIG. 8 is a diagram illustrating a heating temperature distribution of the upper surface of the platen.

FIGS. 7 and 8 are diagrams illustrating heating temperature distributions of the upper surface of the platen 48. Specifically, FIGS. 7 and 8 are diagrams illustrating the heating temperature distributions of the upper surface of the platen 48 when the three heaters are driven. Note that the heating temperature of the upper surface of the platen 48 can be replaced with the sheet-surface heating temperature of the roll sheet S located on the upper surface. In this embodiment, as illustrated in FIGS. 7 and 8, the controller 10 controls the temperature of the heater 52 in the heating temperature distribution of two types.

The heating temperature distribution of the upper surface of the platen 48 illustrated in FIG. 7 is a distribution that is controlled such that the heating temperatures of the three heaters 52 (the upstream heater 52*a*, the central heater 52*b*, and the downstream heater 52*c*) are all set to a constant heating temperature. Thus, during the printing operation of the carriage 42, the upstream heater 52*a*, the central heater 52*b*, and the downstream heater 52*c* heat (warm) the roll sheet S at a constant heating temperature across the upstream end region SA1, the central region SA2, and the downstream end region SA3. Note that this heating temperature distribution is the same as that of the related art.

Note that the heating temperature distribution of the heater 52 illustrated in FIG. 7 is referred to as a heating temperature control condition (1).

Through the operation of the heater 52 under the heating temperature control condition (1), the moisture in the ink are evaporated by heating (warming) the roll sheet S at a constant heating temperature in the upstream end region SA1, the central region SA2, and the downstream end region SA3 of the roll sheet S in the printing region P.

The heating temperature distribution of the upper surface of the platen 48 illustrated in FIG. 8 is a distribution in which, in the three heaters 52, the heating temperature of the upstream heater 52*a* and the downstream heater 52*c* is higher than the heating temperature of the central heater 52*b*. In other words, the heaters 52 (the upstream heater 52*a* and the downstream heater 52*c*) disposed in the upstream end region 48A and the downstream end region 48C serving as the end regions of the platen 48 are set to a heating temperature higher than the heating temperature of the heater 52 (the central heater 52*b*) disposed in the central region 48B of the platen 48. To put it another way, in the drying unit 50 (the heater 52) serving as the drying acceleration part, the drying capacity in the upstream end region 48A and the downstream end region 48C serving as the end regions of the platen 48 is higher than the drying capacity in the central region 48B of the platen 48. Note that the heating temperature of the central heater 52*b* in this case is equal to the temperature of the heating temperature control condition (1) illustrated in FIG. 7.

A heating temperature higher than the heating temperature of the central heater 52*b* is set to the upstream heater 52*a* and the downstream heater 52*c*. However, since a temperature gradient results between the upstream end region 48A and the central region 48B and between the central region 48B and the downstream end region 48C in the platen 48, a distribution including an inclination of the heating temperature is set as illustrated in FIG. 8.

Note that the heating temperature distribution of the heater 52 illustrated in FIG. 8 is referred to as a heating temperature control condition (2).

Through the operation of the heater 52 under the heating temperature control condition (2), the heating temperature of the upstream end region SA1 and the downstream end region SA3 becomes higher than the heating temperature of the central region SA2 in the roll sheet S in the printing region P, and thus the moisture in the ink can be evaporated in the upstream end region SA1 and the downstream end region SA3 where a smear of the ink easily occurs.

Next, the carriage blower 53 is described.

As illustrated in FIG. 4, the carriage blower 53 is disposed at a position at a center in the X direction on both sides in the Y direction, which is the reciprocating movement direction of the carriage 42. Regarding the carriage blower 53, the carriage blower 53 disposed upstream in the transport direction D is referred to as a carriage fan 53*a*, and the carriage blower 53 disposed downstream in the transport direction D is referred to as a carriage fan 53*b*. The carriage blower 53 is configured using an axial fan. The two carriage fans, 53*a* and 53*b*, have the same configuration.

The carriage fan 53*a* is disposed such that the carriage fan 53*a* is inclined to face slightly upstream from the upstream end of the carriage 42, rather than blowing air in the direction perpendicular to the upper surface of the platen 48. In addition, the carriage fan 53*b* is also disposed such that the blowing direction is inclined to face slightly downstream from the downstream end of the carriage 42, rather than blowing air in the direction in the direction perpendicular to the upper surface of the platen 48.

In other words, the carriage fans 53*a* and 53*b* are oriented outward in the Y direction of the carriage 42 such that the blowing directions do not affect the application position of the ink of the print head 41 disposed on the inner side of the carriage 42. Note that in FIG. 4, the directions of the air blown from the carriage fans 53*a* and 53*b* are indicated by arrows.

The carriage fans 53*a* and 53*b* are disposed in the carriage 42 in the above-mentioned manner, and thus the carriage fans 53*a* and 53*b* are configured to send air toward the roll sheet S supported by the platen 48 while moving along with the movement of the carriage 42 (print head 41) in the main scanning direction and the sub-scanning direction.

Here, the air velocity of the airflow discharged from the carriage fan 53*a* is referred to as an air velocity Va, and the air velocity of the airflow discharged from the carriage fan 53*b* is referred to as an air velocity Vb. In this embodiment, the controller 10 controls the air velocities Va and Vb under air velocity control conditions of three types described later.

Figure 9:
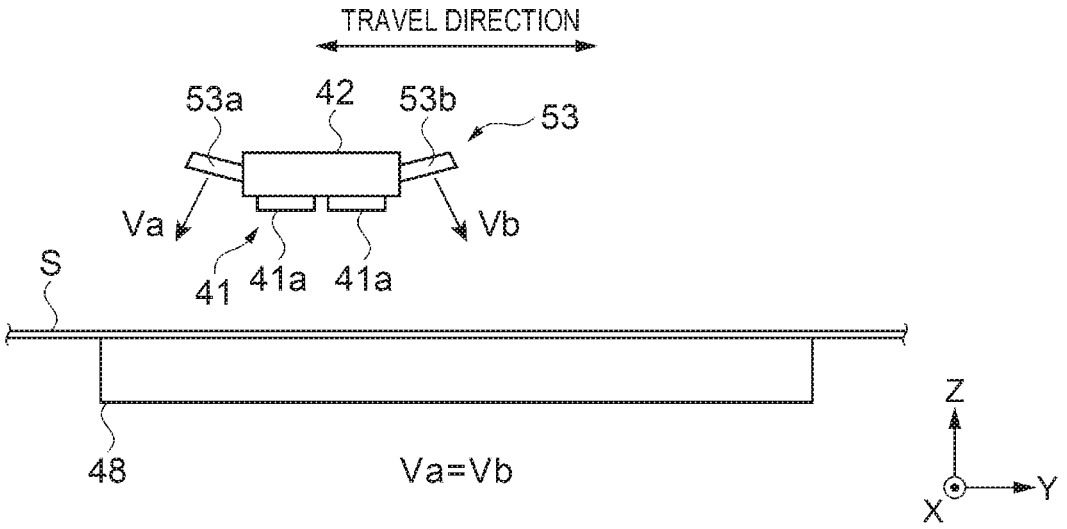
FIG. 9 is a simplified diagram illustrating magnitudes of air velocities of carriage fans on the front side and the rear side in a travel direction.
Figure 10:
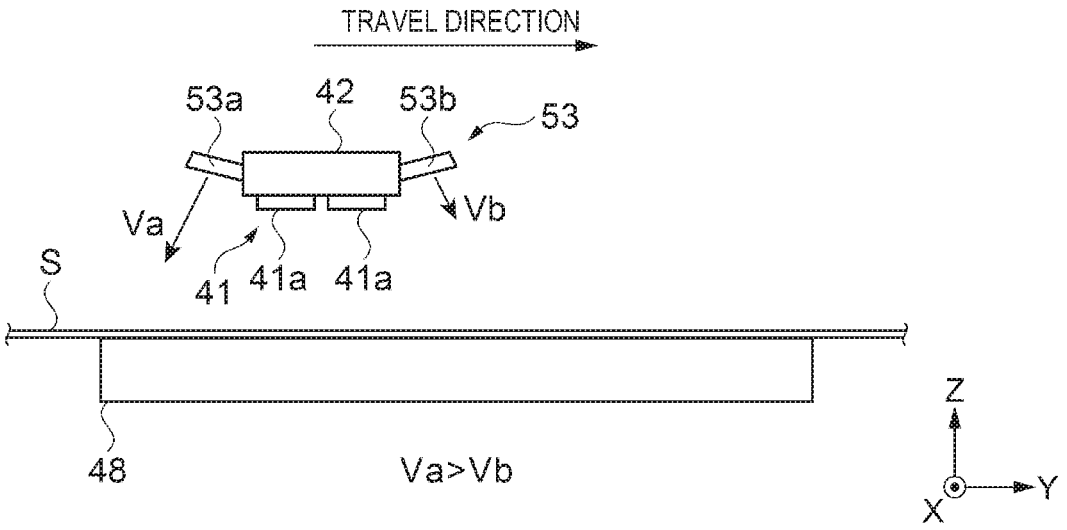
FIG. 10 is a simplified diagram illustrating magnitudes of air velocities of the carriage fans on the front side and the rear side in the travel direction.
Figure 11:
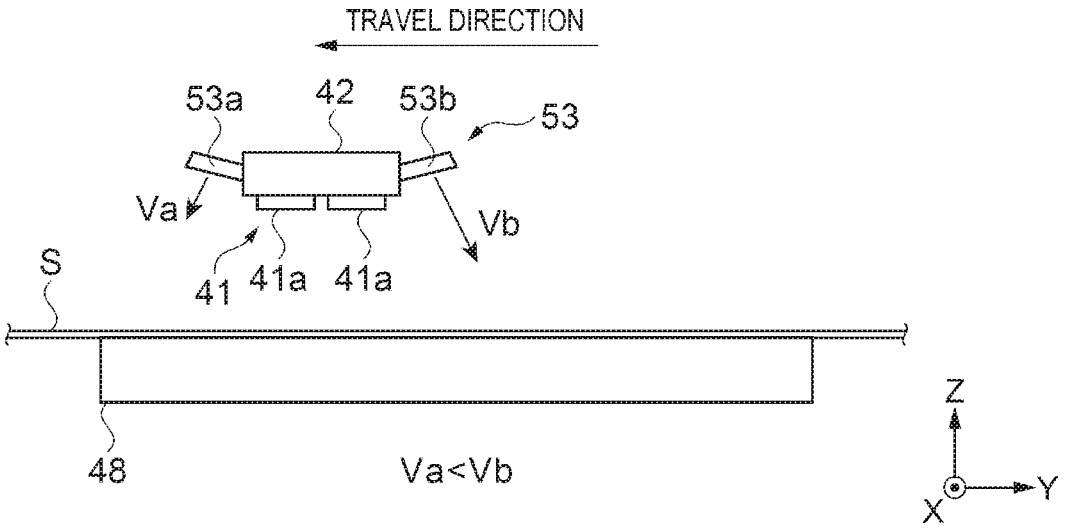
FIG. 11 is a simplified diagram illustrating magnitudes of air velocities of the carriage fans on the front side and the rear side in the travel direction.
Figure 12:
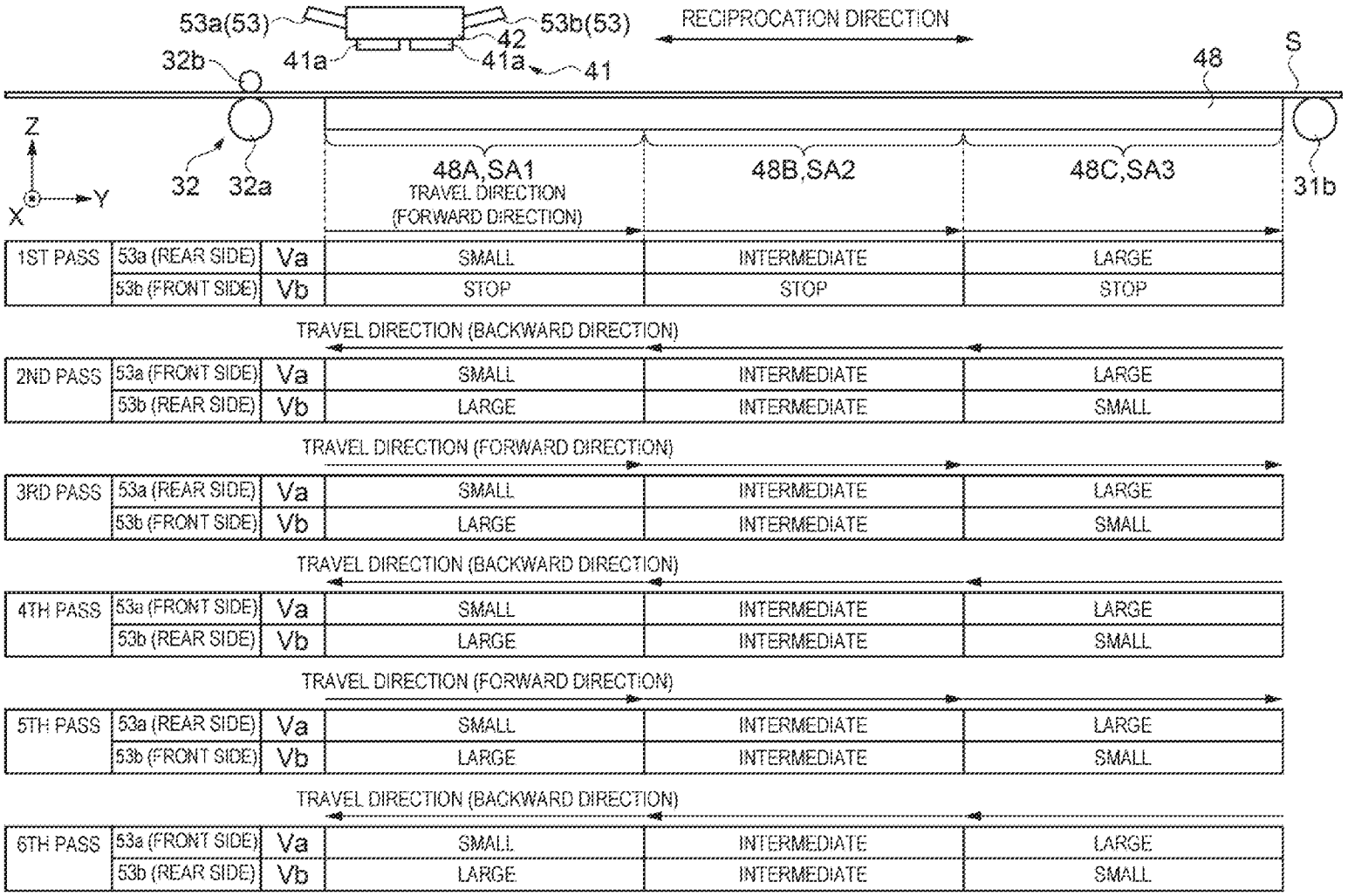
FIG. 12 is a table showing magnitudes of air velocities of the carriage fans in the case where printing is performed in six passes.

FIGS. 9 to 11 are simplified diagrams illustrating magnitudes of the air velocities Va and Vb of the carriage fans 53*a* and 53*b* disposed in the carriage 42. FIG. 12 is a table showing magnitudes of the air velocities Va and Vb of the carriage fans 53*a* and 53*b* in the case where printing is performed in six passes.

The carriage 42 reciprocates in the Y direction (the main scanning direction). In the reciprocation direction, the travel direction of the carriage 42 in the +Y direction is referred to as a forward direction. The travel direction of the carriage 42 in the −Y direction is referred to as a backward direction.

FIG. 9 illustrates a state where the air velocities Va and Vb of the two carriage fans 53*a* and 53*b* disposed in the carriage 42 are both set to an intermediate level regardless of the travel direction. Accordingly, the controller 10 performs control of setting the air velocities Va and Vb of the carriage fans 53*a* and 53*b* to the intermediate level in the forward direction and the backward direction in the reciprocation direction of the carriage 42. Note that this air velocity control is the same as that of the related art.

Note that, the control of the air velocities Va and Vb of the carriage fans 53*a* and 53*b* at the air velocity illustrated in FIG. 9 is referred to as an air velocity control condition (1).

Through the operation of the carriage fans 53*a* and 53*b* under the air velocity control conditions (1), the moisture in the discharged ink is evaporated by setting the air velocities Va and Vb of the carriage fans 53*a* and 53*b* on the front and rear sides of the carriage 42 in the travel direction to the intermediate level.

FIGS. 10 and 11 illustrate a state where the air velocity Va or Vb of the carriage fan 53*a* or the carriage fan 53*b* on the rear side in the travel direction is set to a value greater than that of the air velocity Va or Vb of the carriage fan 53*a* or the carriage fan 53*b* on the front side in the travel direction. Specifically, FIG. 10 illustrates a state where, when the travel direction is the forward direction (+Y direction) in the reciprocation direction of the carriage 42, the air velocity Va of the carriage fan 53*a* on the rear side in the travel direction is set to a value greater than that of the air velocity Vb of the carriage fan 53*b* on the front side in the travel direction. Accordingly, in the forward direction in the reciprocation direction of the carriage 42, the controller 10 performs control of setting the air velocity Va of the carriage fan 53*a* on the rear side in the travel direction to a value greater than that of the air velocity Vb of the carriage fan 53*b* on the front side in the travel direction.

FIG. 11 illustrates a state where, when the travel direction is in the backward direction (−Y direction) in the reciprocation direction of the carriage 42, the air velocity Vb of the carriage fan 53*b* on the rear side in the travel direction is set to a value greater than that of the air velocity Va of the carriage fan 53*a* on the front side in the travel direction. Accordingly, in the backward direction in the reciprocation direction of the carriage 42, the controller 10 performs control of setting the air velocity Vb of the carriage fan 53*b* on the rear side in the travel direction to a value greater than that of the air velocity Va of the carriage fan 53*a* on the front side in the travel direction. In other words, with respect to the carriage fan 53*b* disposed downstream in the transport direction D of the roll sheet S, the carriage fan 53*a* disposed upstream in the transport direction D is set to have a larger air velocity when the travel direction of the carriage 42 is the forward direction (Va>Vb) and have a smaller air velocity when the travel direction is the backward direction (Va<Vb).

Note that the control of the air velocities Va and Vb of the carriage fans 53*a* and 53*b* at the air velocities illustrated in FIGS. 10 and 11 is referred to as an air velocity control condition (2).

Through the operation of the carriage fans 53*a* and 53*b* under the air velocity control condition (2), the moisture in the ink can be efficiently evaporated and dried by controlling the air velocity Va or Vb of the carriage fan 53*b* or the carriage fan 53*a* on the rear side in the travel direction to a value greater than that of the air velocity Va or Vb of the carriage fan 53*a* or the carriage fan 53*b* on the front side in the travel direction in the forward direction and the backward direction. In addition, with the difference (large or small) provided between the magnitude of the air velocity of the carriage fan on the rear side in the travel direction and the magnitude of the air velocity of the carriage fan on the front side in the travel direction, it is possible to efficiently evaporate the moisture in the ink at low power consumption.

FIG. 12 shows magnitudes of the air velocities Va and Vb in the travel direction of the carriage fans 53*a* and 53*b* in each pass in the case where printing is performed in six passes, for example. FIG. 12 shows magnitudes of the air velocities Va and Vb in the travel direction of the carriage fans 53*a* and 53*b* in each pass in the case where, among the printing conditions in FIG. 13 described later, printing is performed in three or more passes in bidirectional printing.

As shown in FIG. 12, the carriage fans 53*a* and 53*b* change the magnitudes of the air velocities Va and Vb among the upstream end region 48A, the central region 48B, and the downstream end region 48C of the platen 48. Note that the upstream end region 48A, the central region 48B, and the downstream end region 48C of the platen 48 correspond to the upstream end region SA1, the central region SA2, and the downstream end region SA3 in the printing region P of the roll sheet S.

As shown in FIG. 12, in the first pass, third pass, and fifth pass, the travel direction of the printing is the forward direction (+Y direction) with the carriage fan 53*a* serving as the carriage fan on the rear side in the travel direction and the carriage fan 53*b* serving as the carriage fan on the front side in the travel direction. In addition, as shown in FIG. 12, in the second pass, fourth pass, and sixth pass, the travel direction of the printing is the backward direction (−Y direction) with the carriage fan 53*a* serving as the carriage fan on the front side in the travel direction and the carriage fan 53*b* serving as the carriage fan on the rear side in the travel direction.

As shown in FIG. 12, in the printing of the first pass, the air velocity Va of the carriage fan 53*a* on the rear side in the travel direction is set to "small", and the air velocity Vb of the carriage fan 53*b* on the front side in the travel direction is set to "stop" in the upstream end region 48A. In the central region 48B, the air velocity Va of the carriage fan 53*a* is set to "intermediate", and the air velocity Vb of the carriage fan 53*b* is set to "stop". In addition, in the downstream end region 48C, the air velocity Va of the carriage fan 53*a* is set to "large", and the air velocity Vb of the carriage fan 53*b* is set to "stop".

In other words, the air velocity of the carriage fan 53*a* of the first pass is changed such that the air velocity is small in the upstream end region 48A, intermediate in the central region 48B, and large in the downstream end region 48C.

The reason for setting the air velocity Vb of the carriage fan 53*b* to "stop" all over the platen 48 is that there is no ink droplets in the blowing direction of the carriage fan 53*b* on the front side in the travel direction because of the printing of the first pass. In addition, the reason for changing the air velocity Va of the carriage fan 53*a* on the rear side in the order of "small", "intermediate", and "large" is that the time until the ink discharged in the second pass hits on the ink applied in the first pass decreases in the order of the upstream end region 48A, the central region 48B, and the downstream end region 48C. Specifically, in order to prevent occurrence of a smear when the ink discharged in the second pass hits the ink applied in the first pass due to insufficient drying of the ink in the lower layer in the hitting of the ink in the second pass, the ink printed in the first pass is dried such that the drying capacity of the carriage fan 53*a* is changed by changing the air velocity Va of the carriage fan 53*a* in accordance with the time until the ink discharged in the second pass hits. In the upstream end region 48A, there is a sufficient time until the ink discharged in the second pass hits, and therefore the ink applied in the first pass can be dried until the ink discharged in the second pass hits even with the "small" air velocity of the carriage fans 53*a*. In the downstream end region 48C, the time until the ink discharged in the second pass hits is insufficient, and therefore the air velocity of the carriage fan 53*a* is set to "large" to increase the drying capacity of the carriage fan 53*a* such that the ink applied in the first pass is dried before the ink discharged in the second pass hits so as to prevent occurrence of a smear.

When printing is performed in the second pass, first, the carriage 42 after completion of the printing of the first pass moves downstream in the forward direction past the downstream end region 48C of the platen 48, and then moves in the sub-scanning direction to switch the travel direction to the backward direction, and thereafter, performs printing of the second pass. As shown in FIG. 12, in the printing of the second pass, the air velocity Va of the carriage fan 53*a* on the front side in the travel direction is set to "large", and the air velocity Vb of the carriage fan 53*b* on the rear side in the travel direction is set to "small" in the downstream end region 48C. In addition, in the central region 48B, the air velocity Va of the carriage fan 53*a* is set to "intermediate", and the air velocity Vb of the carriage fan 53*b* is also set to "intermediate". In addition, in the upstream end region 48A, the air velocity Va of the carriage fan 53*a* is set to "small" and the air velocity Vb of the carriage fan 53*b* is set to "large".

In other words, the air velocity of the carriage fan 53*a* in the second pass is changed such that the air velocity is small in the upstream end region 48A, intermediate in the central region 48B, and large in the downstream end region 48C. In other words, the air velocity of the carriage fan 53*b* in the second pass is changed such that the air velocity is large in the upstream end region 48A, intermediate in the central region 48B, and small in the downstream end region 48C.

When printing is performed by switching the travel direction of the carriage 42 from the first pass to the second pass, the time interval between the printing of the first pass and the printing of the second pass is short, that is, the time interval between the passes is short, in the downstream end region 48C. As such, depending on the property of the ink, the environmental condition and the printing condition, the moisture in the ink may not sufficiently evaporate within the period until the next pass, and then, a smear of the ink may occur. In view of this, in the first pass, when the carriage 42 switches the travel direction, the air velocity Va of the carriage fan 53*a* on the rear side in the travel direction is set to "large" in order to increase the air velocity of the air sent toward the downstream end region 48C. In addition, in the second pass, the air velocity Va of the carriage fan 53*a* on the front side in the travel direction is set to "large". In this manner, the drying capacity of the ink can be improved even in the case where the time interval between the printing of the first pass and the printing of the second pass is short. Note that, in the second pass, the air velocity Va of the carriage fan 53*a* on the front side in the travel direction is set to "large" in the downstream end region 48C to improve the drying capacity for the ink applied in the first pass. Further, regarding the air velocity Vb of the carriage fan 53*b* that is on the rear side in the travel direction and passes over the ink discharged and applied in the second pass on the ink applied in the first pass, there is a sufficient time until the ink discharged in the third pass hits on the ink applied in the second pass, and therefore the ink can be dried even with a "small" air velocity Vb without causing a smear. Therefore, the power consumption can be reduced by setting the air velocity Vb to "small".

When printing is performed in the third pass, first, the carriage 42 after completion of the printing of the second pass moves upstream in the backward direction past the upstream end region 48A of the platen 48, and then moves in the sub-scanning direction to switch the travel direction to the forward direction, and thereafter, performs printing of the third pass.

In the printing apparatus 1, a cleaning unit (not illustrated) for cleaning of the print head 41, a flushing unit (not illustrated) for performing a flushing operation by discharging ink from the nozzle of each print head 41, and the like are disposed upstream (−Y direction) of the platen 48. Then, after the printing of any of the second pass, fourth pass, or sixth pass is performed, the carriage 42 is moved to the above-mentioned units to perform cleaning and flushing of the print head 41.

As shown in FIG. 12, in the printing of the third pass, the air velocity Va of the carriage fan 53*a* on the rear side in the travel direction is set to "small", and the air velocity Vb of the carriage fan 53*b* on the front side in the travel direction is set to "large" in the upstream end region 48A. In addition, in the central region 48B, the air velocity Va of the carriage fan 53*a* is set to "intermediate", and the air velocity Vb of the carriage fan 53*b* is also set to "intermediate". In addition, in the downstream end region 48C, the air velocity Va of the carriage fan 53*a* is set to "large" and the air velocity Vb of the carriage fan 53*b* is set to "small".

In other words, the air velocity of the carriage fan 53*a* in the third pass is changed such that the air velocity is small in the upstream end region 48A, intermediate in the central region 48B, and large in the downstream end region 48C. In other words, the air velocity of the carriage fan 53*b* in the third pass is changed such that the air velocity is large in the upstream end region 48A, intermediate in the central region 48B, and small in the downstream end region 48C.

When printing is performed by switching the travel direction of the carriage 42 from the second pass to the third pass, the time interval between the printing of the second pass and the printing of the third pass is short, that is, the time interval between the passes is short, in the upstream end region 48A. As such, depending on the property of the ink, the environmental condition and the printing condition, the moisture in the ink may not sufficiently evaporate within the period until the next pass, and then, a smear of the ink may occur. In view of this, in the second pass, when the carriage 42 switches the travel direction, the air velocity Vb of the carriage fan 53*b* on the rear side in the travel direction is set to "large" in order to increase the air velocity of the air sent toward the upstream end region 48A. In addition, in the third pass, the air velocity Vb of the carriage fan 53*b* on the front side in the travel direction is set to "large". In this manner, the drying capacity of the ink can be improved even in the case where the time interval between the printing of the second pass and the printing of the third pass is short. Note that, in the third pass, the air velocity Vb of the carriage fan 53*b* on the front side in the travel direction is set to "large" in the upstream end region 48A to improve the drying capacity for the ink applied in the second pass. Further, regarding the air velocity Va of the carriage fan 53*a* that is on the rear side in the travel direction and passes over the ink discharged and applied in the third pass on the ink applied in the second pass, there is a sufficient time until the ink discharged in the fourth pass hits on the ink applied in the third pass, and therefore the ink can be dried even with a "small" air velocity Va without causing a smear. Therefore, the power consumption can be reduced by setting the air velocity Va to "small".

When printing is performed in the fourth pass, first, the carriage 42 after completion of the printing of the third pass moves downstream in the forward direction past the downstream end region 48C of the platen 48, and then moves in the sub-scanning direction to switch the travel direction to the backward direction, and thereafter, performs printing of the fourth pass. As shown in FIG. 12, in the printing of the fourth pass, the air velocity Va of the carriage fan 53*a* on the front side in the travel direction is set to "large", and the air velocity Vb of the carriage fan 53*b* on the rear side in the travel direction is set to "small" in the downstream end region 48C. In addition, in the central region 48B, the air velocity Va of the carriage fan 53*a* is set to "intermediate", and the air velocity Vb of the carriage fan 53*b* is also set to "intermediate". In addition, in the upstream end region 48A, the air velocity Va of the carriage fan 53*a* is set to "small" and the air velocity Vb of the carriage fan 53*b* is set to "large". This setting is the same as the printing state of the second pass.

The air velocity of the carriage fan 53*a* in the fourth pass is the same as that of the second pass, and therefore the description thereof is omitted. In addition, the printing performed in the fifth pass and the sixth pass is the same as the printing in the third pass and the fourth pass, and therefore the description thereof is omitted.

Note that the control of the air velocities Va and Vb of the carriage fans 53*a* and 53*b* at the air velocities shown in FIG. 12 is referred to as an air velocity control condition (3).

In the case where the carriage 42 switches the travel direction through the operation of the carriage fans 53*a* and 53*b* under the air velocity control conditions (3), the air velocity of the carriage fan disposed on the rear side in the travel direction is set to a value larger than that of the carriage fan disposed on the front side in the travel direction in the upstream end region 48A or the downstream end region 48C before the switching. In addition, in the upstream end region 48A or the downstream end region 48C after the switching, the air velocity of the carriage fan disposed on the front side in the travel direction is set to a value larger than that of the carriage fan disposed on the rear side in the travel direction. In other words, the drying unit 50 (the carriage blower 53) as the drying acceleration part is set such that, under the air velocity control condition (3), the drying capacity in the upstream end region 48A and the downstream end region 48C that are the end regions of the platen 48 is higher than the drying capacity in the central region 48B of the platen 48.

Through the operation of the carriage fans 53*a* and 53*b* under the air velocity control condition (3), the moisture in the ink can be efficiently evaporated and dried in the upstream end region 48A or the downstream end region 48C before and after the switching of the travel direction. In addition, with the difference (large, intermediate, small) provided between the magnitudes of the air velocities of the carriage fan, it is possible to efficiently evaporate the moisture in the ink at low power consumption.

FIG. 13 is a table showing suitable combinations of the control conditions of the drying unit 50 as the drying acceleration part for the printing conditions. Note that in FIG. 13, the combinations of control conditions for the printing conditions are described below as combinations A to F.

As shown in FIG. 13, the printing conditions are divided into unidirectional printing and bidirectional printing. The number of passes in the printing conditions indicates a minimum number of printing for completing the printing in both the unidirectional printing and the bidirectional printing.

As described above, the unidirectional printing is a printing method in which printing is performed only in one direction. Specifically, in the unidirectional printing in this embodiment, printing is performed through the movement in the +Y direction as the forward direction of the travel direction, while idle running is performed without performing the printing in the −Y direction as the backward direction. Such operations are repeated in the printing of the second and subsequent passes.

The bidirectional printing is a printing method in which printing is performed in both the forward direction and the backward direction of the travel direction by reciprocating in the main scanning direction.

As shown in the printing conditions of FIG. 13, "unidirectional printing and one pass" means printing that is completed by performing printing in one movement in the +Y direction as the forward direction. In addition, in "unidirectional printing and two or more passes", the printing of the first pass is performed through the movement in the +Y direction as the forward direction, and it is turned back in the backward direction while performing idle running. Thereafter, the carriage 42 is moved in the sub-scanning direction (X direction). Thereafter, the printing of the second pass is performed through the movement in the +Y direction as the forward direction. Thereafter, in the backward direction, it is turned back while performing idle running. By repeating such operations for two or more passes, the printing is completed.

As shown in the printing conditions of FIG. 13, "bidirectional printing and two passes" means printing in which the printing of the first pass is performed through the movement in the +Y direction as the forward direction, and then moved in the sub-scanning direction (X direction), and thereafter, the printing is completed by performing the printing of the second pass through the movement in the −Y direction as the backward direction. In addition, "bidirectional printing and three or more passes" means printing in which the printing is completed in three or more passes by continuing the above-described printing of two or more passes.

In the combination A, with the printing condition "unidirectional printing and one pass", the air velocity control condition of the fixed blower 51 is set to (1) or (2), and the heating temperature control condition of the heater 52 is set to (1) or (2). In this case, by selecting (2) in any of the control conditions, the drying capacity in the upstream end region SA1 and the downstream end region SA3 of the roll sheet S can be improved, and the time from the end of printing to the end of drying and the start of transport of the roll sheet S can be shortened. In addition, in the combination A, the air velocity control condition of the carriage blower 53 is set to (1) or (2). In this case, drying can be efficiently performed by selecting (2) as the air velocity control condition.

In the combination B, with the printing condition "unidirectional printing and two or more passes", the air velocity control condition of the fixed blower 51 is set to (1), the heating temperature control condition of the heater 52 is set to (1), and the air velocity control condition of the carriage blower 53 is set to (1). In this case, since printing in the backward direction is not performed, the time for drying can be ensured, and drying can be achieved with no problems even when each control condition is set to (1).

In the combination C, with the printing condition of "bidirectional printing and two passes", the air velocity control condition of the fixed blower 51 is set to (1) and the heating temperature control condition of the heater 52 is set to (1). In addition, in the combination C, the air velocity control condition of the carriage blower 53 is set to (2) or (3). In this case, printing in the forward direction and the backward direction is performed once, and therefore, in the downstream end region 48C of the platen 48, the time interval between the printing of the first pass and the printing of the second pass as a result of the switching of the travel direction is short, and, sufficient drying cannot be performed. However, since the air velocity control condition is set to (2) or (3), drying can be achieved even with the air velocity control condition set to (1) and the heating temperature control conditions set to (1). While the air velocity control condition may be set to (2), more efficient drying can be performed by selecting (3). In addition, while the amount of ink per unit area is large in the printing performed in two passes, the drying, even in such a case, can be performed by selecting the above-mentioned control conditions. In addition, since the drying can be performed by selecting the efficient control conditions, the consumption of the power for driving the drying unit 50 can be reduced.

In the combination D, with the printing condition of "bidirectional printing and two passes", the air velocity control condition of the fixed blower 51 is set to (1) and the heating temperature control condition of the heater 52 is set to (2). In addition, in the combination D, the air velocity control condition of the carriage blower 53 is set to (2) or (3). In this case, as with the combination C, in the downstream end region 48C of the platen 48, the time interval between the printing of the first pass and the printing of the second pass as a result of the switching of the travel direction is short and sufficient drying cannot be performed. However, by setting the air velocity control condition of the carriage blower 53 to (2) or (3) and setting the heating temperature control condition to (2), the drying capacity can be further improved than the combination C. While the air velocity control condition may be set to (2), more efficient drying can be performed by selecting (3). In addition, while the amount of ink per unit area is large in the printing performed in two passes, the drying, even in such a case, can be performed by selecting the above-mentioned control conditions. In addition, since the drying can be performed by selecting the efficient control conditions, the consumption of the power for driving the drying unit 50 can be reduced, although not as much as the combination C.

In the combination E, with the printing condition of "bidirectional printing and three or more passes", the air velocity control condition of the fixed blower 51 is set to (2) and the heating temperature control condition of the heater 52 is set to (1). In addition, in the combination E, the air velocity control condition of the carriage blower 53 is set to (2) or (3). In this case, in the downstream end region 48C and the upstream end region 48A of the platen 48, the time interval between printing in the forward pass and the printing in the backward pass as a result of the switching of the travel direction is short, and sufficient drying cannot be performed. However, by setting the air velocity control condition of the carriage blower 53 to (2) or (3) and setting the air velocity control condition of the fixed blower 51 to (2), the drying capacity can be improved for printing of three or more passes even when the heating temperature control condition is set to (1). While the air velocity control condition may be set to (2), more efficient drying can be performed by selecting (3). In addition, since the drying can be performed by selecting the efficient control conditions, the consumption of the power for driving the drying unit 50 can be reduced for printing of three or more passes. In addition, since efficient drying can be performed, high-speed printing can be achieved.

In the combination F, with the printing condition of "bidirectional printing and three or more passes", the air velocity control condition of the fixed blower 51 is set to (2) and the heating temperature control condition of the heater 52 is set to (2). In addition, in the combination F, the air velocity control condition of the carriage blower 53 is set to (2) or (3). In this case, as with the combination E, in the downstream end region 48C and the upstream end region 48A of the platen 48, the time interval between printing of the forward pass and the printing of the backward pass as a result of the switching of the travel direction is short, and sufficient drying cannot be performed. However, by setting the air velocity control condition of the carriage blower 53 to (2) or (3) and the air velocity control condition of the fixed blower 51 to (2), and, the heating temperature control condition to (2), the drying capacity can be further improved. While the air velocity control condition may be set to (2), more efficient drying can be performed by selecting (3). In addition, since the drying can be performed by selecting the efficient control conditions, the consumption of the power for driving the drying unit 50 can be reduced for three or more passes, although not as much as the combination E. In addition, since efficient drying can be performed, further high-speed printing can be achieved.

Note that, the present disclosure is not limited to the embodiments described above, and various modifications and improvements can be added to the above-described embodiments. Modifications are described below.

2. Modifications

In FIGS. 10 and 11, as the air velocity control condition (2), the air velocity Va or Vb of the carriage fan 53*a* or the carriage fan 53*b* on the rear side in the travel direction is controlled to a value greater than the air velocity Va or Vb of the carriage fan 53*a* or the carriage fan 53*b* on the front side in the travel direction, in the forward direction and the backward direction. In other words, in the forward direction and the backward direction, the air velocity of the carriage fan on the rear side in the travel direction is controlled to a value greater than that of the air velocity of the carriage fan on the front side in the travel direction.

However, this is not a limitation, and it is also possible to set the air velocity of the upstream end region 48A and the downstream end region 48C as the end regions of the platen 48 to a value greater than the air velocity of the central region 48B. Specifically, the air velocities Va and Vb of the carriage fans 53*a* and 53*b* may be set to "large" in the upstream end region 48A and the downstream end region 48C, and may be set to "intermediate" or "small" in the central region 48B in both the forward direction and the backward direction. In addition, the control of the air velocities Va and Vb of the carriage fans 53*a* and 53*b* as described in this modification may be set as a new air velocity control condition.

According to this modification, the drying capacity of the carriage blower 53 may be set to be greater in the upstream end region 48A and the downstream end region 48C of the platen 48 than in the central region 48B of the platen 48 in the reciprocation direction of movement of the carriage 42.

Contents derived from the above-mentioned embodiments and modification are described below.

A printing apparatus includes a support part configured to support a recording medium, a printing part configured to form an image by discharging ink to the recording medium supported by the support part while reciprocating in a main scanning direction, and a drying acceleration part configured to accelerate drying of the ink discharged by the printing part and applied on the recording medium in a state where the recording medium is supported by the support part, wherein a drying capacity of the drying acceleration part is set such that the drying capacity is higher in an end region of the support part than in a central region of the support part in a reciprocation direction of the printing part.

With this configuration, since the drying capacity of the drying acceleration part is set such that the drying capacity is higher in the end region of the support part than in the central region of the support part in the reciprocation direction of the printing part, the drying capacity in the end region of the recording medium that corresponds to the end region of the support part can be set to a value greater than that of the drying capacity in the central region of the recording medium. Thus, an occurrence of a smear in the end region of the recording medium can be suppressed. In addition, since it suffices to increase the drying capacity only in the region where a smear occurs, and it is not necessary to uniformly increase the drying capacity in the entire region, the power consumption for the drying can be reduced.

Preferably, in the above-described printing apparatus, the reciprocation direction of the printing part and a transport direction of the recording medium are parallel to each other.

With this configuration, the reciprocation direction of the printing part and the transport direction of the recording medium are parallel to each other, and thus, in printing of a recording medium that is an elongated medium such as roll sheet, enhanced efficiency of the printing can be achieved, and the size reduction can be achieved in the arrangement of the drying acceleration part, for example.

Preferably, in the above-described printing apparatus, the drying acceleration part is a plurality of fixed fans disposed above the printing part in such a manner as to face the support part, and an air velocity of the fixed fan that is disposed at a position facing the end region of the support part is greater than an air velocity of the fixed fan that is disposed at a position facing the central region of the support part.

With this configuration, since the drying acceleration part is the plurality of fixed fans disposed above the printing part in such a manner as to face the support part, and the air velocity of the fixed fan that is disposed at a position facing the end region of the support part is greater than the air velocity of the fixed fan that is disposed at a position facing the central region of the support part, the drying capacity in the end region of the recording medium that corresponds to the end region of the support part can be set to a value greater than that of the drying capacity in the central region of the recording medium. Thus, an occurrence of a smear in the end region of the recording medium can be suppressed. In addition, since it suffices to increase the air velocity only in the region where a smear occurs, and it is not necessary to uniformly increase the air velocity in the entire region, the power consumption for the drying can be reduced.

Preferably, in the above-described printing apparatus, the drying acceleration part is a heater provided at the support part, and a heating temperature of the heater disposed in the end region of the support part is higher than a heating temperature of the heater disposed in the central region of the support part.

With this configuration, since the drying acceleration part is the heater provided at the support part, and the heating temperature of the heater disposed in the end region of the support part is higher than the heating temperature of the heater disposed in the central region of the support part, the drying capacity in the end region of the recording medium that corresponds to the end region of the support part can be set to a value greater than that of the drying capacity in the central region of the recording medium. Thus, an occurrence of a smear in the end region of the recording medium can be suppressed. In addition, since it suffices to increase the heating temperature only in the region where a smear occurs, and it is not necessary to uniformly increase the heating temperature in the entire region, the power consumption for the drying can be reduced.

Preferably, in the above-described printing apparatus, the drying acceleration part is a carriage fan disposed on both sides of a carriage in the reciprocation direction, the carriage being configured to support a print head and move in the main scanning direction, the print head being configured to discharge the ink, and the carriage fan is set such that an air velocity in the end region of the support part is greater than an air velocity in the central region of the support part.

With this configuration, the drying acceleration part includes the carriage fan disposed on both sides in the reciprocation direction of the carriage configured to support the print head and move in the main scanning direction. The print head is configured to discharge ink. Further, the air velocity in the end region of the support part is set to a value greater than that of the air velocity in the central region of the support part. In this manner, the drying capacity in the upstream end region and the downstream end region of the support part can be set to a value greater than that of the drying capacity in the central region of the support part. Thus, an occurrence of a smear in the end region of the recording medium can be suppressed. In addition, since it suffices to increase the magnitude of the air velocity only in the region where a smear occurs, and it is not necessary to uniformly increase the magnitude of the air velocity in the entire region, the power consumption for the drying can be reduced.

Preferably, in the above-described printing apparatus, the drying acceleration part is a carriage fan disposed on both sides of a carriage in the reciprocation direction, the carriage being configured to support a print head and move in the main scanning direction, the print head being configured to discharge the ink, an air velocity of the carriage fan disposed upstream in a transport direction of the recording medium is changed such that the air velocity is small in an upstream end region, intermediate in the central region, and large in a downstream end region in the transport direction in the support part, and an air velocity of the carriage fan disposed downstream in the transport direction is changed such that the air velocity is large in the upstream end region, intermediate in the central region, and small in the downstream end region.

With this configuration, the drying acceleration part includes the carriage fan disposed on both sides in the reciprocation direction of the carriage Further, the air velocity of the carriage fan disposed upstream in the transport direction of the recording medium is changed such that the air velocity is small in the upstream end region, intermediate in the central region, and large in the downstream end region in the transport direction in the support part. In addition, the air velocity of the carriage fan disposed downstream in the transport direction is changed such that the air velocity is large in the upstream end region, intermediate in the central region, and small in the downstream end region. In this manner, when the carriage switches the travel direction, the carriage fan disposed on the rear side in the travel direction has a larger air velocity than the carriage fan disposed on the front side in the travel direction in the end region before the switching. In addition, in the end region after the switching, the carriage fan disposed on the front side in the travel direction has a larger air velocity than the carriage fan disposed on the rear side in the travel direction. In this manner, the drying capacity in the end region of the recording medium corresponding to the end region of the support part can be increased together with the drying capacity in the central region of the recording medium. Thus, an occurrence of a smear in the end region of the recording medium can be suppressed. In addition, since it suffices to increase the magnitude of the air velocity only in the region where a smear easily occurs, and it is not necessary to increase the magnitude of the air velocity in the entire region, the power consumption for the drying can be reduced.

What is claimed is:

1. A printing apparatus comprising:

a support part configured to support a recording medium;

a printing part configured to form an image by discharging ink to the recording medium supported by the support part while reciprocating in a main scanning direction that is perpendicular to a transport direction of the recording medium; and a drying acceleration part configured to accelerate drying of the ink discharged by the printing part and applied on the recording medium in a state where the recording medium is supported by the support part, wherein a drying capacity of the drying acceleration part is set such that the drying capacity is higher in an end region of the support part than in a central region of the support part, and the end region is in the main scanning direction that is perpendicular to the transport direction of the recording medium.

2. The printing apparatus according to claim 1, wherein the reciprocation direction of the printing part and a transport direction of the recording medium are parallel to each other.

3. The printing apparatus according to claim 1, wherein the drying acceleration part is a plurality of fixed fans disposed above the printing part in such a manner as to face the support part; and an air velocity of the fixed fan that is disposed at a position facing the end region of the support part is greater than an air velocity of the fixed fan that is disposed at a position facing the central region of the support part.

4. The printing apparatus according to claim 1, wherein the drying acceleration part is a heater provided at the support part; and a heating temperature of the heater disposed in the end region of the support part is higher than a heating temperature of the heater disposed in the central region of the support part.

5. The printing apparatus according to claim 1, wherein the drying acceleration part is a carriage fan disposed on both sides of a carriage in the reciprocation direction, the carriage being configured to support a print head and move in the main scanning direction, the print head being configured to discharge the ink; and the carriage fan is set such that an air velocity in the end region of the support part is greater than an air velocity in the central region of the support part.

6. The printing apparatus according to claim 1, wherein the drying acceleration part is a carriage fan disposed on both sides of a carriage in the reciprocation direction, the carriage being configured to support a print head and move in the main scanning direction, the print head being configured to discharge the ink;

an air velocity of the carriage fan disposed upstream in a transport direction of the recording medium is changed such that the air velocity is small in an upstream end region, intermediate in the central region, and large in a downstream end region in the transport direction in the support part; and an air velocity of the carriage fan disposed downstream in the transport direction is changed such that the air velocity is large in the upstream end region, intermediate in the central region, and small in the downstream end region.

* * * * *